US009022837B2

(12) United States Patent
Pöhlitz

(10) Patent No.: US 9,022,837 B2
(45) Date of Patent: May 5, 2015

(54) HONING MACHINE FOR INNER HONING AND OUTER HONING

(71) Applicant: Gehring Naumburg GmbH & Co., Naumburg (DE)

(72) Inventor: Günther Pöhlitz, Naumburg (DE)

(73) Assignee: Gehring Naumburg GmbH & Co., Naumburg (DE)

( * ) Notice: Subject to any disclaimer, the term of this patent is extended or adjusted under 35 U.S.C. 154(b) by 105 days.

(21) Appl. No.: 13/771,104

(22) Filed: Feb. 20, 2013

(65) Prior Publication Data

US 2014/0057535 A1 Feb. 27, 2014

(30) Foreign Application Priority Data

Feb. 20, 2012 (DE) ..... 10 2012 202 548

(51) Int. Cl.

| | |
|---|---|
| ***B24B 27/00*** | (2006.01) |
| ***B24B 33/02*** | (2006.01) |
| ***B24B 33/04*** | (2006.01) |
| ***B24B 33/08*** | (2006.01) |
| ***B24B 33/10*** | (2006.01) |

(52) U.S. Cl.

CPC ..... *B24B 33/022* (2013.01); *B24B 33/04* (2013.01); *B24B 33/027* (2013.01); *B24B 33/08* (2013.01); *B24B 33/105* (2013.01)

(58) Field of Classification Search

CPC B24B 27/006; B24B 33/022; B24B 33/0027; B24B 33/04; B24B 33/082; B24B 33/105

USPC ..... 451/210, 246, 464, 479, 51, 58, 61

See application file for complete search history.

(56) References Cited

U.S. PATENT DOCUMENTS

| | | | | | |
|---|---|---|---|---|---|
| 1,397,660 | A | * | 11/1921 | Rouze | 451/464 |
| 1,707,988 | A | * | 4/1929 | Nordal | 451/479 |
| 1,827,789 | A | * | 10/1931 | Hutto | 451/476 |
| 1,846,371 | A | * | 2/1932 | Sunnen | 451/479 |
| 1,873,330 | A | * | 8/1932 | Rottler | 451/479 |
| 1,877,328 | A | * | 9/1932 | Jeschke | 451/479 |
| 1,886,584 | A | * | 11/1932 | Prange | 451/479 |

(Continued)

FOREIGN PATENT DOCUMENTS

| | | |
|---|---|---|
| DE | 28 56 623 C2 | 7/1980 |
| DE | 88 14 248.5 U1 | 2/1989 |

(Continued)

OTHER PUBLICATIONS

Flores G.: Grundlagen und Anwendungen des Honens; Vulkan-Verlag, Essen, Germany, 1992, ISBN 3-08027-2904-8; p. 119.

*Primary Examiner* — George Nguyen
(74) *Attorney, Agent, or Firm* — Gudrun E. Huckett

(57) ABSTRACT

A honing machine has at least one clamping unit that clamps a workpiece and has a rotary drive for the workpiece. A spindle unit has a stroke drive for an inner honing tool for inner honing of the workpiece. An outer honing device that is movable relative to the workpiece in an axial direction of the workpiece is provided. The outer honing device has several honing stones and an advancing device acting on the honing stones. The honing stones each are advanced in a radial direction relative to the workpiece. The advancing device has at least one linear drive for each one of the honing stones and a common drive motor for all of the linear drives.

19 Claims, 5 Drawing Sheets

(56) References Cited

U.S. PATENT DOCUMENTS

| | | | | | |
|---|---|---|---|---|---|
| 1,997,978 | A | * | 4/1935 | Raule | 451/51 |
| 2,647,348 | A | * | 8/1953 | Hahn | 451/14 |
| 2,649,664 | A | * | 8/1953 | Sunnen | 451/213 |
| 2,998,681 | A | * | 9/1961 | Calvert | 451/464 |
| 3,070,926 | A | * | 1/1963 | Kidd | 451/483 |
| 4,651,475 | A | * | 3/1987 | Appleby et al. | 451/470 |
| 5,088,237 | A | * | 2/1992 | Nagel et al. | 451/27 |
| 5,255,476 | A | * | 10/1993 | Rutter | 451/487 |
| 5,651,720 | A | * | 7/1997 | Shinomoto et al. | 451/8 |
| 5,782,674 | A | * | 7/1998 | Hahn | 451/9 |
| 5,899,795 | A | * | 5/1999 | Penza | 451/61 |
| 6,074,282 | A | * | 6/2000 | Schimweg | 451/49 |
| 6,406,360 | B1 | * | 6/2002 | Nguyen et al. | 451/75 |
| 6,558,240 | B2 | * | 5/2003 | Negley | 451/464 |
| 2001/0034196 | A1 | * | 10/2001 | Hyatt et al. | 451/61 |
| 2010/0089878 | A1 | * | 4/2010 | Halser | 219/121.39 |
| 2010/0147325 | A1 | * | 6/2010 | Hafemann | 132/271 |
| 2014/0057535 | A1 | * | 2/2014 | Pohlitz | 451/210 |

FOREIGN PATENT DOCUMENTS

| | | | | | |
|---|---|---|---|---|---|
| DE | 38 42 046 | A1 | | 6/1990 | |
| DE | 10 2006 024 677 | A1 | | 11/2007 | |
| GB | 1 412 568 | | | 11/1975 | |
| JP | 59232755 | A | * | 12/1984 | B24B 5/40 |

* cited by examiner

HONING MACHINE FOR INNER HONING AND OUTER HONING

BACKGROUND OF THE INVENTION

The invention relates to a honing machine for inner honing and outer honing with which thin-walled pipes can be machined on the inner side as well as on the outer side simultaneously or sequentially. However, on this honing machine conventional parts such as piston rods can also be machined only on the outer side and long pipes can be honed only on the inner side.

When the pipes to be machined are to be honed on their inner and outer surfaces, a simultaneous machining of the inner and outer surfaces is of great advantage. Such a machining process can be realized with the honing machines according to the invention in the vertical direction as well as in the horizontal direction.

DE 28 56 623 C2 discloses a horizontal honing machine for outer honing of shafts. The shaft is clamped in a spindle unit with rotary drive action and a tail stock. During machining, the shaft carries out a rotational movement. The tool is moved in longitudinal direction and feeds the honing stones radially. The long stroke movement of the inner honing tool is superimposed with an oscillating movement of the honing stones that is also coaxially oriented so that a wave-shaped course of the honing traces is generated. In this way, the material removal efficiency is to be increased significantly. This honing machine is exclusively designed for outer honing of piston rods and does not allow for conversion to inner machining.

German utility model G 88 14 248.5 discloses also outer machining of cylindrical bearing pins wherein however the entire kinematics of stroke, rotation and central feed movement is performed by the inner honing tool. The workpiece itself is at rest.

In the book "Grundlagen and Anwendungen des Honens" (translation: Principles and Applications of Honing); author Gerhard Flores, Vulkan-Verlag, Essen, Germany 1992, ISBN, 3-8027-2904-8, on page 119, an outer honing process on a vertical honing machine is disclosed. A conventional honing machine is illustrated with which honing can be performed on the inner side as well as on the outer side of a workpiece. However, this is not possible simultaneously; the second machining step can be performed only after retrofitting. The outer honing tool is mounted fixedly on the machine table and the workpiece is supported by a double joint. The honing stones can be fed hydraulically or mechanically.

SUMMARY OF THE INVENTION

It is an object of the present invention to provide a honing machine on which simultaneously as well as sequentially an inner honing process as well as an outer honing process can be performed on a workpiece.

In accordance with the present invention, this is achieved for a honing machine, comprising a spindle unit with a stroke drive for an inner honing tool for inner honing of a workpiece and at least one clamping unit for the workpiece, in that the clamping unit has a rotary drive for the workpiece to be machined.

In the honing machine according to the invention, the spindle unit must perform only an oscillating movement in the direction of the longitudinal axis of the bore to be machined. The rotary movement required for honing is generated by a rotary drive of the clamping unit. The workpiece to be machined is clamped in the clamping unit. With this configuration of the honing machine, there is the possibility of performing an inner honing process as well as an outer honing process on this honing machine.

A further advantageous embodiment of the invention provides an outer honing device that is movable relative to the workpiece in axial direction. In this way, it is possible to hone a workpiece on the outer side without the outer honing device performing a rotary movement. This is enabled in that the honing machine according to the invention has a clamping unit with rotary drive action. The outer honing process is carried out by rotating the workpiece, driven by the spindle of the clamping unit. The rotary drive action of the clamping unit can be used for inner honing as well as for outer honing.

The outer honing device is advantageously arranged on a carriage that performs on oscillating movement parallel to the longitudinal axis of the workpiece to be machined. The stroke and advancing or feeding movements are performed by the tool. This carriage can be moved, for example, by a toothed rack drive in axial direction of the workpiece. Of course, other types of linear drives can be used.

Based on the concept of the honing machine according to the invention, it is possible that a workpiece is machined by inner honing and at the same time also machined by outer honing. However, it is also possible that a workpiece is machined only by inner honing or only by outer honing. The honing machine according to the invention provides thus an unknown flexibility in comparison to the prior art with regard to the processing modes and the workpieces to be machined.

The flexibility of the honing machine according to the invention is still further increased in that the rotary drive action of the clamping unit can be locked. In this way, a conventional inner honing process is possible in which the workpiece is fixedly clamped and the inner honing tool is performing a rotary movement. For this purpose, it is necessary that the spindle unit has a rotary drive and this rotary drive is advantageously lockable. This locking action can be advantageous when a workpiece is to be processed at the same time by inner and outer honing.

In this case, the honing stones of the inner honing tool and of the outer honing device should be arranged opposite each other so that the pressure forces that are occurring during honing are directly transmitted through the tubular workpiece from one honing stone to the oppositely positioned one. As a result, no elastic deformations of the workpiece to be machined will occur. This results in an increased processing performance while simultaneously the quality of the workpiece to be machined is improved.

However, it may also be advantageous when the spindle unit and together with it the inner honing tool carry out an opposite rotational movement relative to the rotary clamping unit. In this way, an increased material removal on the inner side of the pipe can be realized. However, in this way the honing angle becomes more flat also.

It is furthermore advantageous when the spindle unit has an advancing device (feeding device) for the inner honing tool.

Moreover, the inner honing tool is connected with a spindle of the spindle unit by an articulation, preferably is supported by a Cardan suspension (gimbal). In this way, it is possible that the honing stones of the inner honing tool across their entire length can adapt in the best possible way to the bore to be machined. In an appropriate way, it is advantageous when the outer honing device is supported by Cardan suspension on the carriage. In this way, a similar effect is obtained, i.e., the honing stones of the outer honing device adapt across their entire length in the best possible way to the surface of the workpiece to be machined.

In a further advantageous embodiment, the outer honing device can be coupled with the spindle unit in axial direction in order to avoid speed deviations of inner honing tool relative to the outer honing device. This means that the oscillating stroke movement of the inner honing tool and the oscillating stroke movement of the outer honing device are performed synchronously. In this way, the same honing angles for the inner honing process and the outer honing process are achieved. Also, it is ensured that the honing stones of the inner honing tool and of the outer honing device during the honing process will not change their position relative to each other at least in axial direction.

The coupling device is adjustable with regard to its length so that the outer and inner honing stones have the same axial position and can support each other. In this connection, the own axial drive of the outer honing device must be switched off or both axial drives must be synchronously controlled by the control unit in a suitable way.

When the honing stones are arranged opposite each other, elastic deformations of the workpiece during machining are prevented effectively. In this way, in particular thin-walled pipes can be honed with high removal efficiency as well as optimal precision. In particular in case of machining of thin-walled pipes it is therefore advantageous when the honing stones of the inner honing tool and of the outer honing device have the same position relative to the workpiece. Moreover, it is desirable and advantageous when the same number of honing stones are provided on the inner honing tool and on the outer honing device and when the honing stones of the inner honing tool and outer honing device have the same length.

In some applications, in particular in outer honing processes, it is advantageous when the clamping unit has a tail stock.

The aforementioned object is also solved by an outer honing device with several honing stones wherein each honing stone is feedable in radial direction, the outer honing device characterized in that an advancing device for the honing stones has at least one linear drive for each one of the honing stones and a common drive motor for all linear drives. With this configuration of the outer honing device according to the invention, it is ensured that all of the linear drives are advanced or fed uniformly.

Moreover, the configurational expenditure and mass are reduced because only one drive motor is required. As a result of this, only one drive motor must thus be controlled.

The advancing device (or feeding device) according to the invention that, together with the outer honing device, carries out an oscillating stroke movement during honing treatment is mechanically very robust and can be easily controlled with regard to control technology.

As linear drives, various configurations are possible. The linear drive can be embodied as a toothed rack drive or can be a ball screw.

In order to prevent tilting of the honing stones, it is particularly advantageous when each of the honing stones is fed by means of e.g. two toothed racks in radial direction. In this way, it is ensured that the contact force between honing stone and workpiece across the entire length of the honing stone is constant, independent of the wear of the honing stone.

In order to apply the required contact forces, in many cases it is advantageous to arrange upstream of the advancing device a reducing gear, preferably a planetary gear, a harmonic-drive gear and/or an angular gear. An eccentric planetary gear is particularly advantageous because it reduces the advancing or feeding movement of the drive motor to smallest radial advancing steps and with its self-locking action secures the advanced honing stones in the radial position.

This means that the drive motor can be de-energized (switched to currentless state) as soon as the advancing movement has been completed. With a great reducing ratio of the gear, the torque that is to be applied by the common drive motor for performing an advancing or feeding movement is reduced. As a result, the mass and the size of the drive motor can be reduced. This is particularly advantageous because the drive motor also participates in the oscillating stroke movement of the outer honing device.

A particularly advantageous coupling of the common drive motor with the advancing devices of the honing stones is a toothed belt. It is understood that the drive motor has a pinion of a matching shape and that the advancing devices also have pinions. At the same time, the toothed belt can serve as an overload protection for the advancing devices.

For compensation of possible positional errors of the workpiece surface to be machined, the honing stones are supported by a Cardan suspension (gimbal) in a common frame. The workpiece is fixedly clamped in the spindle of the clamping unit and can be supported at its free end at the center by means of a tip of a tail stock.

It is possible to employ diamond, cBN, but also conventional cutting materials such as silicon carbide or corundum.

In order to ensure a particularly advantageous Cardan suspension of the outer honing device, it is provided that the outer honing device has two spaced-apart structures that are connected fixedly to each other and in that the honing stones, the linear drives and the reducing gear are arranged between the two structures. In this way, a very lightweight and still high-strength structure of the outer honing device is provided. Guiding of the honing stones between these structures is ensured and, moreover, it is possible to arrange between these structures a ring on which the structures are rotatably supported. This first type of support between ring and the structures is a first axis of rotation of the Cardan suspension according to the invention. Advantageously, the ring is in turn rotatably supported on the carriage of the honing machine, wherein the axes of rotation of both supports are orthogonal to each other. In this way, a very efficient and precise Cardan suspension of the outer honing device is ensured.

The Cardan suspension (gimbal) according to the invention prevents tilting moments from acting on the outer honing device because the Cardan suspension, viewed in axial direction, is arranged between the structures of the outer honing device and the honing stones are arranged also at this location. In this way, the processing precision is further increased.

The outer honing device according to the invention is advantageously suitable for use on the honing machine according to the present invention as claimed.

Further advantages and advantageous embodiments of the invention are disclosed in the following drawing, the description, and the claims. All features that are disclosed in the drawing, the description and the claims can be important for the invention individually as well as in any suitable combination with each other.

DESCRIPTION OF THE PREFERRED EMBODIMENTS

Figure 1:
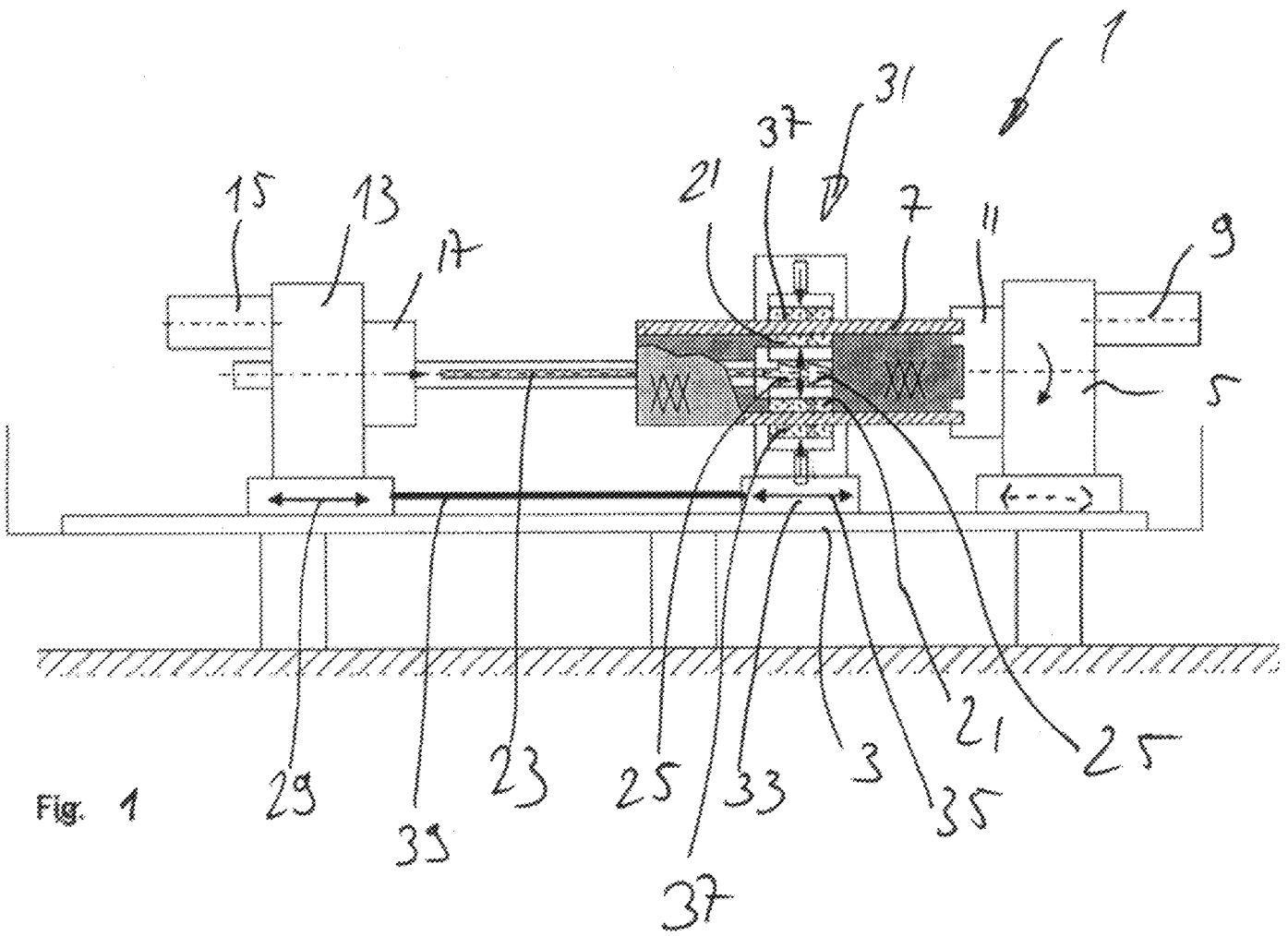
FIG. 1 shows simultaneous outer honing and inner honing with a honing machine according to the invention.

FIG. 1 discloses a honing machine according to the invention for simultaneous outer honing and inner honing in a schematic representation. The honing machine 1 comprises a machine bed 3. On this machine bed 3, a clamping unit 5 for the workpiece 7 to be machined is provided; the workpiece is a thin-walled pipe. The clamping unit 5 is not movable in axial direction; it is screwed onto the machine bed 3. However, it can be designed to be movable in axial direction and is then moved by means of a linear drive (not illustrated in FIG. 1) in axial direction. It is then possible that the clamping unit 5 performs during honing an oscillating movement in axial direction.

The clamping unit 5 comprises a drive motor 5 that can drive a clamping means 11 in which the workpiece 7 is clamped. When the drive motor 9 is activated, the clamping means 11 and thus also the workpiece 7 rotate. Drive motor 9 and clamping means 11 together form a drive device. However, it is also possible to lock the clamping means 11 so that the workpiece 7 cannot perform a rotary movement.

At the other end of the machine bed 3 a spindle unit 13 that also has a drive motor 15 is arranged. The drive motor 15 serves for rotating a spindle 17 of the spindle unit 13 as needed. On the spindle 17 an inner honing tool 19 for inner honing is mounted. The inner honing tool 19 is connected as is known in the art by a Cardan suspension (gimbal) with the spindle 17 so that the honing stones 21 of the inner honing tool 19 in the best possible way can adapt to and contact the inner wall of the workpiece 7.

The inner honing tool 19 comprises an advancing device (feeding device: the terms advancing and feeding are used in this application interchangeably) which is substantially comprised of a feeding rod 23 and feeding cones 25 connected to the feeding rod 23. When the feeding rod 23 is moved in axial direction relative to the inner honing tool 19, the feeding cones 25 effect a radial advancing or feeding movement of the honing stones 21. The feeding rod 23 of the inner honing tool 19 is actuated by means of the spindle unit 13.

The spindle unit 13 is movable in axial direction, i.e., in the direction of the longitudinal axis of the workpiece 7, on the machine bed 3. In this way it is possible that the inner honing tool 19 carries out an oscillating movement in the interior of the workpiece 7 to be machined. The oscillating stroke movement of the spindle unit 13 is indicated by a double arrow 29 in FIG. 1.

The spindle unit 13 may have as a spindle drive a multistage hand-switched mechanical gear for preadjusting the rotary speed. The servo function of the drive motor serves for fine adjustment of the rotary speed.

An electromechanical advancing device (not illustrated) is integrated into the spindle unit 13 and carries out the advancing or feeding movement of the inner honing tool 19. The advancing devices carries out a controlled rotary movement that effects a relative rotation relative to the rotary movement of the spindle 17. This relative rotation is utilized for advancing the inner honing tool 19.

The spindle 17 can be locked in the spindle unit 13. This is advantageous when the workpiece 7 is to be machined by outer honing and inner honing at the same time.

When a honing process is to be performed with the honing machine 1 according to the invention, there are several options. The first option provides that the workpiece 7 is caused to rotate by the clamping unit 5. In this case, the inner honing tool 19 generally only performs an oscillating movement and does not rotate.

Alternatively, it is also possible of course that the clamping means 11 of the clamping unit 5 is locked and the inner honing tool 19 carries out a rotational movement as well as an oscillating stroke movement, as is standard practice in conventional inner honing.

Of course, it is also possible that the workpiece 7 as well as the inner honing tool 19 carry out a rotational movement.

According to the invention, an outer honing device 31 is provided that is mounted on a carriage 33. The carriage 33 is also movable in axial direction of the workpiece 7 on the machine bed 3. The oscillating stroke movement of the carriage 33 is indicated by double arrow 29 in FIG. 1.

The outer honing device 31 comprises several honing stones 37 that are resting on (contacting) the outer surface of the workpiece 7. The honing stones 37 are feedable in radial direction inwardly. The feeding movements of the honing stones 21 and 37 are indicated by arrows (without reference characters) in the drawing.

The (rotary) clamping unit 5 causes the clamped workpiece to rotate such that in interaction with the oscillating stroke movements of the inner honing tool 19 and the outer honing device 31 the desired honing angles are adjusted on the workpiece 7 on the inner side and the outer side.

The spindle unit 13 receives the honing tool for inner honing, in the following also referred to as inner honing tool 19, in an articulate connection between spindle 17 and inner honing tool 19 so that the inner honing tool 19 with its honing stones 21 can align with the inner surface of the workpiece 7.

Care must be taken that the lengths of the honing stones 21, 37 of inner honing tool and outer honing device are identical as much as possible so that for the same axial position of the tools the workpiece 7 is supported externally and internally completely and in this way no lateral shape deviation will be produced.

When finish-honed surfaces on the inner side as well as on the outer side are required exclusively, after the honing process and retraction of the inner honing tool and outer honing device, the clamping end clamped in the (rotation) clamping unit 5 can be dressed to size with a machining unit, not illustrated in detail, by means of a cutting tool. However, in this connection it is necessary to catch the workpiece 7 subsequent to separation by support belts (not illustrated) so that the workpiece 7 after the parting step does not drop and become damaged.

When the workpiece 7 with its clamping end projects into the rotary clamping unit 5 (see FIG. 1), these clamping surfaces are to be prepared appropriately as steps in the premachining process. In this way, the honing stones 37 can move across the bore edge.

In the inner and outer honing process according to the invention, it is particularly advantageous that the inner and outer honing steps are performed simultaneously and even a thin-walled pipe will not become deformed, for example, by machining forces of an inner honing tool 19. The simultaneous contact of the honing stones 21, 37 of both tools stabilizes the workpiece 7 in its initial position and the machining quality is independent of the wall thickness of the workpiece 7.

In FIG. 1, an important advantage of the honing machine 1 according to the invention becomes apparent. The honing stones 21 for inner honing that are arranged in the section plane and the honing stones 37 of the outer honing device for outer honing that are also arranged in the section plane are positioned directly opposite each other. In between them, the wall of the tubular workpiece 7 is positioned. This means that the advancing or feeding forces of the honing stones 21 and 37 are supported by the respective oppositely positioned honing stones. In this way, an elastic deformation of the workpiece 7 cannot occur. This enables not only machining of workpieces 7 that have a very thin wall but also enables at the same time a higher removal efficiency; this increases the economic viability of the machining process with the honing machine 1 according to the invention significantly.

Of course, the inner honing tool 19 and the outer honing device 31 each do not have just two honing stones 21 or 37. In many applications, four, six or more honing stones 21 and 37 are distributed uniformly about the circumference wherein these honing stones 21 and 37 for the aforementioned reasons are preferably positioned directly opposite each other.

Since the outer honing device 31 as well as the inner honing tool 19 perform an oscillating movement in the direction of the longitudinal axis of the workpiece 7, it must be ensured that the honing stones 21 and 37 are not only arranged in circumferential direction opposite each other but that during machining of the workpieces 7, they also assume always the same axial position. This can be realized either in that the control of the spindle unit 13 and of the carriage 33 is done synchronously. Modern machining controls enable this generally. Often, the spindle unit 13, the carriage 33, and the clamping unit 5 will utilize the same toothed rack (not illustrated) on the machine bed 3.

An even simpler and very reliable method of coupling the axial position of the spindle unit 13 and carriage 33 resides in that a coupling rod 39 between the spindle unit 13 and the carriage 33 is arranged. This coupling rod 39 ensures that the honing stones 21 and 37 always have the same axial position. In this case, for example, the drive of the carriage 33 can be deactivated so that the oscillating stroke movements of the outer honing device 31 as well as of the inner honing tool 19 are performed exclusively by the spindle unit 13.

For achieving a higher oscillation frequency, it is also possible to control the drives of the spindle unit 13 and of the carriage 33 in axial direction and to utilize the coupling rod 39 essentially as an additional safety measure or for compensation of short-term acceleration differences. In this case, the coupling rod 39 could be designed to have a smaller size because it must transmit only minimal "differential" forces between the spindle unit 13 and the carriage 33. Moreover, the axial drive of the spindle unit 13 is relieved.

As already mentioned, it is possible to either arrest or to lock the spindle 17 as well as the clamping means 11. In this way, the honing machine 1 according to the invention provides a variety of possible operating modi that are compiled infra in table form.

Figure 2:
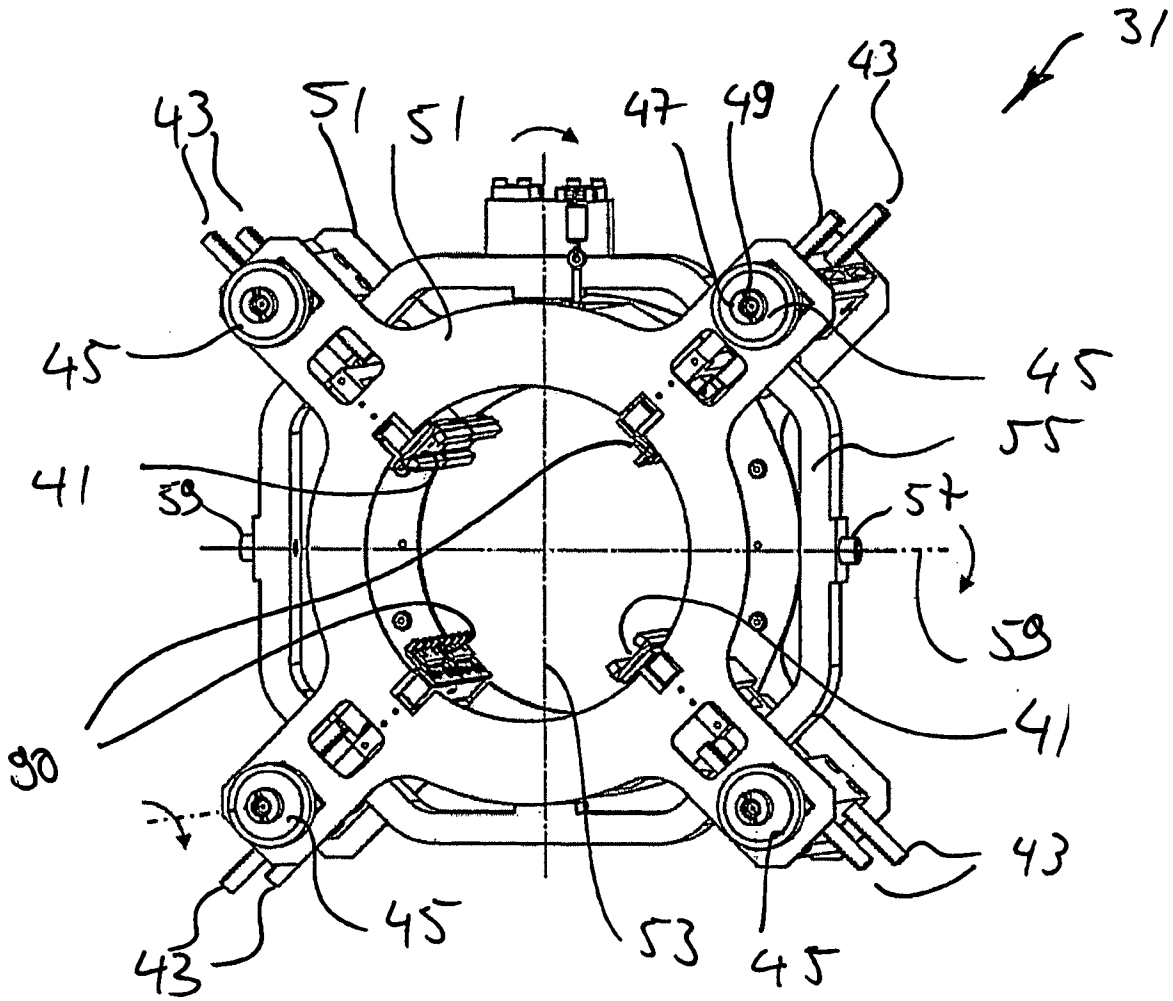
FIG. 2 shows an outer honing device in isometric view.

FIG. 2 shows the outer honing device 31 with its Cardan suspension (gimbal) without the common drive.

In FIG. 2, two honing stone holders 41 are illustrated in which the honing stones 37, not illustrated, can be inserted. Also, two sliding block holders 90 are illustrated.

As a whole, the illustrated outer honing device 31 is designed such that four honing stones 37 (see FIG. 1) can be received and can be advanced in radial direction inwardly. Accordingly, eight honing stones are used when the outer honing device 31 has four honing stone holders 41.

The radial advancing or feeding action is realized by means of two toothed racks 43. Since the honing stones or the honing stone holders 41 are loaded at their leading or trailing end by a toothed rack 43, respectively, with the advancing force, the honing stones will not tilt and a uniform removal by means of the honing stones 37 is achieved for their entire service life. This leads to an improved machining result and increased removal efficiency.

The pinions that drive the toothed racks 43 are not visible in FIG. 2. They are however supported on a rotary axle that is driven in turn by a reducing gear 45. The reducing gear 45 is preferably designed as a planetary gear or a different type of reducing gear. The planetary gears are characterized in that they enable a great reducing ratio, that they are self-locking, and require minimal drive torque in order to transmit the required advancing force via the pinions, not illustrated, onto the toothed rack 43 and thus onto the honing stone holders 41 and the honing stones 37.

In FIG. 2, the input shafts 47 of the reducing gear 45 are illustrated. These input shafts 47 have a groove 49 which, similar to the slot of a screw, serve for transmitting the required input torque. For simplifying the drawing, same components of the different linear drives are not always identified with their reference characters.

The linear drives are arranged between two structures 51 that are, for example, manufactured of sheet steel and are arranged to extend parallel to each other. In FIG. 2, a first axis of rotation 53 is arranged vertically. The structures 51 and therefore the linear drives of the outer honing device are rotatably supported about first axis of rotation 53 in a ring 55. The support is not illustrated in detail in FIG. 2. It is realized advantageously by means of pins and corresponding bearing bushings.

The ring 55 is arranged between the structures 51 and the pairs of toothed racks 43. Two bearing pins 57 are arranged on the ring 55 and define a second axis of rotation 59. The first axis of rotation 53 and the second axis of rotation 59 form the Cardan suspension of the outer honing device 31.

Because the axes of rotation 53 and 59 are positioned in a common plane and this common plane extends at the center of the honing stones or of the honing stone holders 41, an ideal force distribution of the honing stones or an optimal contact of the honing stones on the workpiece to be machined is provided.

Figure 3:
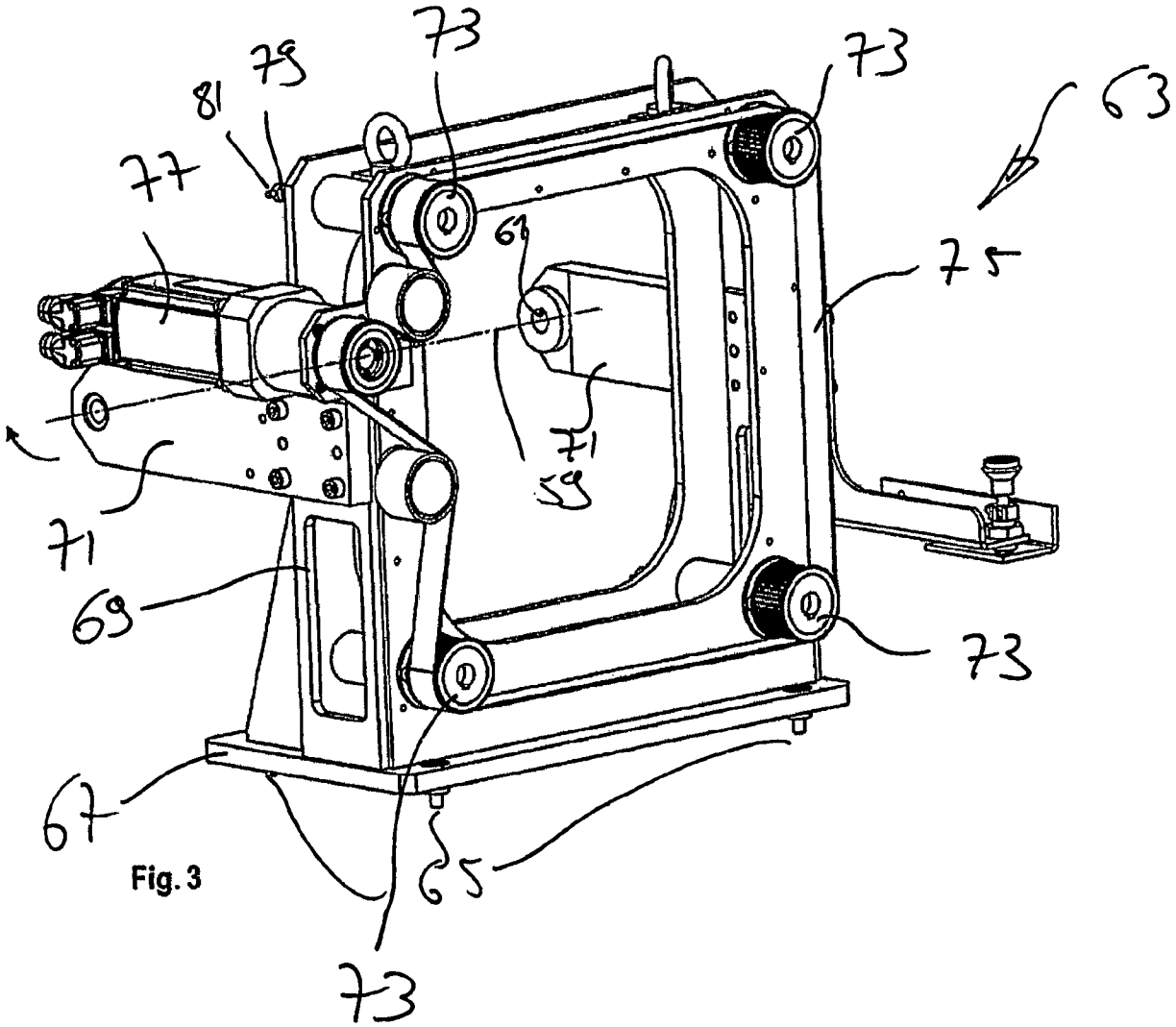
FIG. 3 shows the drive of the outer honing device according to the invention.

In FIG. 3, a further part of the outer honing device 31 according to the invention is illustrated. The second axis of rotation 59 is shown as well as the corresponding bearing bushings 61 that serve for receiving the bearing pins 57 of the ring 55 (see FIG. 2).

In FIG. 3, a support 63 is illustrated which is arranged/attached to the carriage 33 (see FIG. 1). The corresponding fastening screws 65 are indicated in FIG. 3. The support 63 comprises a frame 69 in addition to a base plate 67.

On the frame 69, two brackets 71 are attached by screws on which the bearing bushings 61 are arranged. On the frame 69 there are four toothed belt pulleys 73 that can be driven by means of a toothed belt 75 and a drive motor 77.

When the drive motor 77 is activated, the toothed belt pulleys 73 are rotated and in turn the drive shafts 79 as well, respectively; in FIG. 3 only one drive shaft 79 is shown. On their rearward end in FIG. 3, the drive shafts 79 have a dihedral member 81 which engages the grooves 49 of the input shafts 47.

The transmission of the drive movement from the fixed frame 69 onto the outer honing device 31 supported by Cardan suspension is realized by means of spherical profiles with transverse pins on the drive pins so that an angular deflection is possible but still a torque transmission for advancing the honing stones 37 is possible.

Alternatively, the drive shafts 79 can be designed similar to a conventional Cardan shaft. It enables in any case a length compensation between the frame 69 or the support 63, connected fixedly to the carriage 33, and the structures 51 or the input shafts 47 of the total of four linear drives.

It is understood that the geometric locations where the toothed belt pulleys 73 or the drive shafts 79 are connected to the frame 69 are selected such that the drive shafts are immediately directed toward the input shafts 47 of the reducing gear 45.

Figure 4:
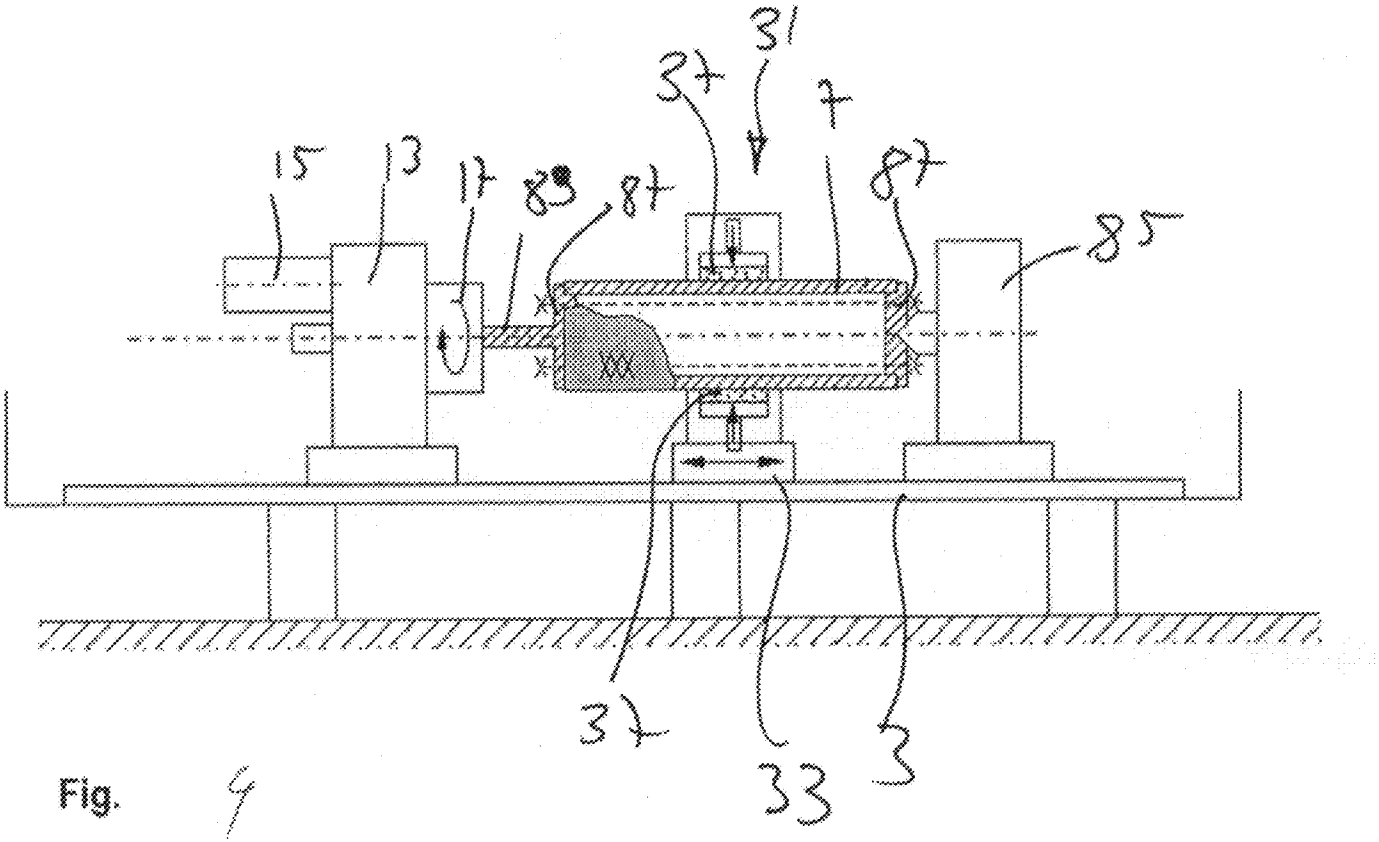
FIG. 4 shows the honing machine according to the invention performing an outer honing process.
Figure 5:
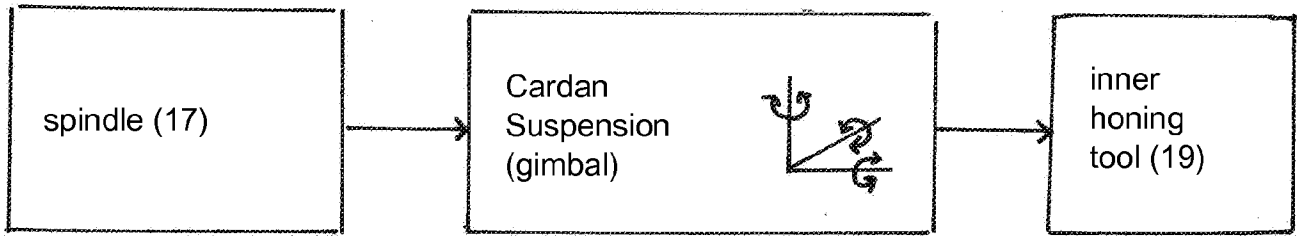
FIG. 5 shows schematically the connection of the spindle (17) and of the inner honing tool (19) by a schematically indicated Cardan suspension (gimbal).

In FIG. 4, a further application, in this case outer honing, of the honing machine 1 according to the invention is illustrated.

In this application, no inner honing tool 19 is provided but the workpiece 7 is supported and driven with corresponding clamping means 87, 89 in the spindle 17 of the spindle unit 13. In order for the opposite end of the workpiece 7 to be prevented from deviating radially, the workpiece is received in a rotating or stationary tip of a tail stock 85. The receiving devices for the workpiece 7 are comprised substantially of attachment plates 87 with a fitting means that center the workpiece 7 at its inner diameter, a centering bore for the fixed tip of the tail stock 85, and a pin 89 which is clamped in the spindle 17 of the spindle unit 13.

Because the attachment plates 87 with respect to their diameter are somewhat smaller than the outer diameter of the workpiece 7, the honing stones 37 during machining can pass across the end of the workpiece 7 so that a cylindrical geometry across the entire length of the workpiece 7 to be machined is achieved reliable and precisely. The rotational movement that is required for outer honing is transmitted from the spindle 17 onto the workpiece 7.

In this application, the spindle unit 13 and the tail stock 85 are not movable in axial direction. The oscillating stroke movement during outer honing is carried out by the carriage 33 of the outer honing device 31.

The linear drive or drives for the spindle unit 13, carriage 33 and/or clamping unit 5 can be embodied e.g. as a chain drive, a toothed rack drive, a hydraulic cylinder, or a ball screw.

When carrying out outer honing, a drive shaft with Cardan suspension is used for workpiece rotation. A satisfactory kinematic determination is provided for the system by the outer honing device with Cardan suspension and the reception of the workpiece in the tip or in the rotary clamping device.

The honing machine 1 according to the invention can be operated in various ways.

In the (operating) mode 1, the spindle unit 13 and the outer honing device 31 are exclusively axially moved with the same stroke speed. The rotational movement of the workpiece 7 is generated by the axially fixedly arranged rotary clamping unit 5.

In the mode 2, the spindle unit 13 and the outer honing device 31 are stationary but arranged at a defined spacing for ensuring the same axial position of the honing stones 21, 37. The rotary clamping unit 5 takes over the stroke and rotational movement of the workpiece 7 in that it carries out in axial direction an oscillating movement. In this context, it can utilize the same toothed rack that is mounted on the machine bed and that is used by the carriage 33 and the spindle unit 13 as well.

Simultaneous Inner and Outer Honing

| | spindle unit | outer honing device | rotary clamping unit |
|---|---|---|---|
| mode 1 | axial: movable<br>rotation: stationary | axial: movable<br>rotation: stationary | axial: stationary<br>rotation: movable |
| mode 2 | axial: stationary<br>rotation: stationary | axial: stationary<br>rotation: stationary | axial: movable<br>rotation: movable |

Outer Honing Only

| | spindle unit | outer honing device | rotary clamping unit |
|---|---|---|---|
| mode 3 | axial: stationary<br>rotation: movable | axial: movable<br>rotation: stationary | axial: stationary<br>rotation: stationary |

Inner Honing Only

| | spindle unit | outer honing device | rotary clamping unit |
|---|---|---|---|
| mode 4 | axial: movable<br>rotation: movable | —<br>— | axial: stationary<br>rotation: stationary |

The specification incorporates by reference the entire disclosure of German priority document 10 2012 202 548.0 having a filing date of Feb. 20, 2012.

While specific embodiments of the invention have been shown and described in detail to illustrate the inventive principles, it will be understood that the invention may be embodied otherwise without departing from such principles.

What is claimed is:

1. A honing machine comprising:

at least one clamping unit adapted to clamp a workpiece;

a spindle unit comprising a stroke drive for an inner honing tool for inner honing of the workpiece;

an outer honing device adapted to be movable relative to the workpiece in an axial direction of the workpiece.

2. The honing machine according to claim 1, further comprising a carriage on which the outer honing device is arranged.

3. The honing machine according to claim 1, wherein the at least one clamping unit comprises a rotary drive for the workpiece.

4. The honing machine according to claim 1, wherein the spindle unit has a rotary drive, wherein the rotary drive of the spindle unit or the spindle unit is lockable.

5. The honing machine according to claim 1, wherein the spindle unit has an advancing device acting on the inner honing tool.

6. The honing machine according to claim 1, wherein the spindle unit comprises a spindle and the inner honing tool is supported with an articulation on the spindle.

7. The honing machine according to claim 6, wherein the articulation is a Cardan suspension.

8. The honing machine according to claim 1, further comprising a carriage on which the outer honing device is supported by a Cardan suspension.

9. The honing machine according to claim 1, wherein the outer honing device is coupled with the spindle unit in the axial direction.

10. The honing machine according to claim 1, wherein the inner honing tool has first honing stones and the outer honing device has second honing stones and wherein the first and second honing stones have a same position relative to the workpiece.

11. The honing machine according to claim 10, wherein the number of the first honing stones provided on the inner honing tool and the number of the second honing stones provided on the outer honing device are identical and the first and second honing stones have the same length.

12. The honing machine according to claim 1, wherein the at least one clamping unit comprises a tail stock.

13. The honing machine according to claim 1, wherein the outer honing device comprises several honing stones and an advancing device acting on the honing stones, wherein the honing stones each are adapted to be advanced in a radial direction relative to a workpiece, wherein the advancing device has at least one linear drive for each one of the honing stones and a common drive motor for all of the linear drives.

14. The honing machine according to claim 3, wherein the rotary drive of the at least one clamping unit is lockable.

15. An outer honing device comprising several honing stones and an advancing device acting on the honing stones, wherein the honing stones each are adapted to be advanced in a radial direction relative to a workpiece, wherein the advancing device has at least one linear drive for each one of the honing stones and a common drive motor for all of the linear drives, wherein the advancing device comprises a reducing gear selected from the group consisting of a planetary gear, a harmonic drive gear, and an angular gear, and a combination thereof.

16. The outer honing device according to claim 15, wherein the advancing device comprises a toothed belt and the common drive motor drives with the toothed belt the linear drives or the reducing gear.

17. The outer honing device according to claim 16, comprising two spaced apart structures wherein the spaced-apart structures are fixedly connected to each other and wherein the honing stones, the linear drives and/or the reducing gear are arranged between the two structures.

18. The outer honing device according to claim 17, further comprising a ring arranged between the two structures, wherein the two structures are supported rotatably on the ring about a first axis of rotation.

19. The outer honing device according to claim 18, further comprising a carriage, wherein the ring is supported rotatably on the carriage about a second axis of rotation, wherein the first and second axes of rotation are orthogonal to each other.

* * * * *